United States Patent [19]

Blaha

[11] 3,958,208

[45] May 18, 1976

[54] CERAMIC IMPEDANCE DEVICE

[75] Inventor: Robert F. Blaha, Dedham, Mass.

[73] Assignee: Texas Instruments Incorporated, Dallas, Tex.

[22] Filed: June 5, 1974

[21] Appl. No.: 476,636

[52] U.S. Cl. ..... 338/22 R; 338/316

[51] Int. Cl.² ..... H01C 7/10; H01C 1/016

[58] Field of Search ..... 317/261; 338/22 R, 260, 338/316, 320, 204, 205

[56] References Cited

UNITED STATES PATENTS

| | | | |
|---|---|---|---|
| 2,398,088 | 4/1946 | Ehlers | 317/261 X |
| 3,227,983 | 1/1966 | Braun | 338/204 |
| 3,278,815 | 10/1966 | Booe | 317/261 X |
| 3,586,934 | 6/1971 | Nakata | 317/261 |
| 3,750,082 | 7/1973 | Petersen | 338/316 |
| 3,835,434 | 6/1973 | Kahn | 338/22 |

*Primary Examiner*—E. A. Goldberg
*Attorney, Agent, or Firm*—John A. Haug; James P. McAndrews; Russell E. Baumann

[57] ABSTRACT

An impedance device and particularly one using several ceramic resistive elements of positive temperature coefficient of resistivity, each of which has metallized contact surfaces thereon, is provided with a casing and with improved means for locating the resistive elements within the casing while making electrical contact to the metallized surfaces of the resistive elements.

5 Claims, 2 Drawing Figures

CERAMIC IMPEDANCE DEVICE

BACKGROUND AND SUMMARY OF INVENTION

Figure 1:
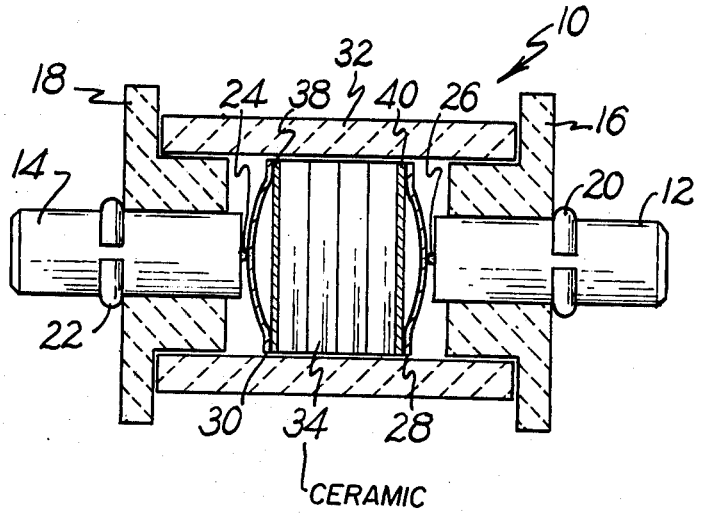

Ceramic impedance elements and especially those having positive temperature coefficients of resistivity (PTC) have found wide application in many electrical devices. The unique property of having a fairly consistent resistance until the element reaches a predetermined temperature and of then very rapidly increasing in resistance for small additional temperature rises is very useful in various temperature sensing and thermally responsive switch applications. Such ceramic resistive elements are available from several commercial sources.

In a typical example of such a commercially available ceramic type resistive element, the element is formed of a PTC material such as lanthanum-doped barium titanate. This PTC material is generally made into disc-shaped resistive pills which have metallized coatings applied to opposite lateral surfaces thereof to provide conductive surfaces to which electrical contact can be made for directing electrical current through the pills. A continuing problem with commercially available pills of this type is that the thickness of the pills will vary from pill to pill. This fact makes it difficult to find a housing and contacting system which can accommodate the tolerance differences that occur when using the commercially available pills. Another problem is that the metallized coatings on the commercially available pills tend to have wide variations in the thickness of the coating and in the coatings' resistance to wear. With these problems it is difficult to find a suitable economical housing and contacting system for the resistive elements.

It is an object of the present invention to provide an improved impedance device incorporating ceramic impedance elements and to provide such a device with an improved housing and contacting system. It is a further object of the invention to provide for a system with a long life. It is still a further object to provide for a system which is economical to manufacture and is readily adaptable to mass production. Other objects will be in part apparent and in part pointed out hereafter.

The above objects are achieved by the invention by using a ceramic or other insulating material case which houses a ceramic impedance element such as a ceramic thermistor element that can be made up of one or more ceramic PTC pills between two resilient spring contacts. The use of these two resilient spring contacts allow the individual pill size to vary within reasonable tolerances and yet still be able to make contact with the spring contacts. This invention also calls for the use of a thin metallic disc having the same surface configuration as the ceramic thermistor element and which is inserted between the metallized surface of the element and the resilient sping contact. This metallic disc is needed because, when a voltage is applied across the ceramic element, the element heats up thus causing expansion to occur which, in turn, causes the resilient spring contact to become more compressed and to laterally rub against the metallized surface of the ceramic element. This rubbing action begins to wear through the metallized surface of the thermistor element and therefore to destroy the electrical conductive path between it and the resilient spring contact. The metallic disc exhibits a low contact resistance so as to not greatly increase the electrical resistance of the device while providing a uniform contacting surface between the metallized surface of the ceramic element and the resilient spring contact. The life of the device is therefore greatly increased because the point defects in the metallized surface due to rubbing and galling are greatly reduced.

This invention accordingly comprises the elements and combination of elements, features of construction and arrangement of parts which will be exemplified in the structures hereinafter described and the scope of the application of which will be indicated in the appended claims.

Figure 2:
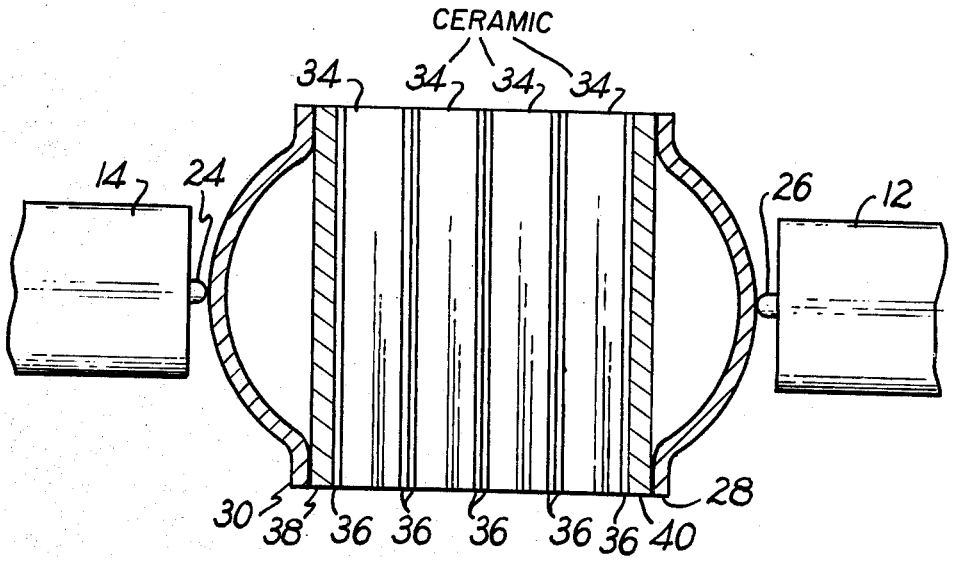

In the following drawings in which one of the various possible embodiments of the invention is illustrated:

FIG. 1 is a cross-sectional view of the apparatus made according to the invention; and FIG. 2 is a partial section view to enlarged scale of the ceramic thermistor pills with metallic disc and wave spring elements at each side in contact with respective terminals.

Referring to the drawings, this invention includes a ceramic type impedance device and particularly a resistive device indicated generally at 10 in FIG. 1. Such a resistive device 10 is of the type which either greatly increases or decreases its resistance for small temperature changes at or above a selected temperature called the anomaly temperature. This resistive device 10 contains two terminals 12 and 14 which are mounted in the two ceramic end caps 16 and 18 of the casing of the device by press-fitting or in other conventional manner. If desired each of the terminals 12 and 14 has a clip 20 and 22 which encircles the end portion of the terminal outside of the ceramic end caps 16 and 18 and help to hold the terminals 12 and 14 in the desired position and to prevent pressing of the terminal too far into its end cap during use. The terminals 12 and 14 must be positioned so that the contact points of the terminal 24 and 26 are always held in contact with the two wave spring contacts 28 and 30 to apply a selected force to the wave spring contacts but still not exerting such a force against these wave spring contacts 28 and 30 so as to compress them to an excessive extent.

In accordance with this invention epoxy is used to join a cylindical casing body 32 to the end caps 16 and 18. The entire casing is made of any common ceramic material or other insulating material such as a ceramic commonly known as steatite. This ceramic acts as a good electrical insulator for the resistive device.

Positioned between the wave spring contacts 28 and 30 within the device 10 are one or more ceramic resistive elements 34 (as best shown in FIG. 2). Where more than one element 34 is used the elements are arranged in stacked heat-transfer relation as shown in FIG. 2 with the metallized surfaces of the elements in contact with each other for connecting the elements in electrical series relation. In accordance with this invention, two conductive metallic discs 38 and 40 are also disposed with the device 10 between respective wave spring contacts and the opposite sides of the resistive element 34, on the opposite ends of a stack of resistive elements 34 as will be understood. The conductive metallic discs 38 and 40 are made out of any metal or combination of metals having good electrical properties such as copper or brass and are made in a configuration to correspond to the contacting surface of the ceramic resistive pill with which it makes contact. In a typical case of the present invention, the discs 38 and 40 are made out of bright tin plated copper ½ inch diameter by .015 inches thick.

In accordance with this invention each of the ceramic resistive elements 34, as shown in FIG. 2, is in the form of a flat cylindrical mass of ceramic-like maerial having PTC characteristics at temperatures above the anomaly temperature. While any convenient size element can be used, each element is desirably quite thin because the thicker the pill the greater the chance of thermal banding occurring with the pill. In a typical case, for example, each element 34 is ½ inch diameter by 0.110 inches thick. Examples of material which have the desired PTC characteristics are, for example, lanthanum-doped barium titanate typically known as empirical formula of $Ba_{.997}LA_{.003}TiO_3$, doped barium strontium titanate ($BaSrTio_3$), doped barium lead titanate ($BaPbTio_3$), or the like. When such material is placed in a power circuit, it initially draws a substantial amount of current which rapidly raises its temperature to a certain value without substantial change in resistance. As the temperature continues to rise, an anomaly temperature is reached beyond which the resistance rapidly increases with only a small increase in temperature. It is to be understood that one or more than one PTC pill 34 in heat transfer relationship with each other can be used and not only the four as described in the preferred embodiment of the invention as illustrated in FIGS. 1 and 2.

Each of these PTC elements 34 has electrically conductive layers 36 on spaced opposite flat surfaces forming an ohmic contact. Typically, these layers 36 are applied by flame spraying aluminum as set forth in U.S. Pat. No. 3,676,211 assigned to the assignee of the instant invention in order to maximize bond strength and low contact resistance between the coating and the PTC materials of the element.

In this arrangement of the device 10, the resistive elements 34 are easily assembled inside the cylinder 32 forming the major part of the device casing. The metal discs 38 and 40 are then easily assembled in the device along with the wave spring contacts 28 and 30. The end caps 16 and 18 of the casing, with attached terminals 12 and 14, are then easily assembled with the casing cylinder so that the terminals 12 and 14 make good electrical contact with respective wave springs 28 and 30 and so that the resilient wave spring contacts bear against the discs 38 and 40, making good electrical contact with the discs, for pressing the discs against the metallized surfaces of resistive elements 34 to position the resistive elements within the device 10 and to make good electrical contact between the discs and the resistive elements. The wave spring contacts provide resilient positioning of the resistive elements in the device and resilient electrical contact to the elements. Accordingly, the elements are easily accommodated in the device even though there may be significant variations in the thicknesses of the elements as commercially available. Further, the resilient mounting and contacting permits thermal expansion of the resistive elements during heating of the elements. The insertion of the conductive metallic discs 38 and 40 between the external metallic layers of the pills and the wave spring contacts permits this resilient positioning and contacting of the resistive elements without causing any reduction in the service life of the device 10. That is, while the bond strength of the aluminum layer 36 in the resistive elements 34 is good, the layer is quite subject to wear due to rubbing and galling. If the wave spring contacts 28 and 30 were to bear directly against the coatings 36 on the resistive elements, rubbing and galling of the coating would occur as the pills 34 were heated and expanded against the wave spring contacts 28 and 30. A similar problem could be caused by shifting between the metallic layers 36 of the pills 34 and the wave spring contact points due to misalignment or excessive movement of the elements in the device under shock or vibration conditions. Since this aluminum layer 36 provides electrical contact to the pills 34, the device 10 would fail to operate properly if this layer were removed by rubbing or galling. However, the discs 38 and 40 greatly retard any rubbing and galling of the metallized element surfaces. The discs 38 and 40 protect the conductive layer by having a large surface contacting area. The wave spring contacts still rub against the discs but the discs can withstand the rubbing much better than the corresponding metallic layers of the pills. The discs protect the conductive layer of the pill and helps to greatly increase the life of the device.

It is understood that this invention also covers the use of a ceramic capacitive element in conjunction or in place of the ceramic resistive element. Also various changes can be made in the above construction without departing from the scope of this invention. It is intended that all matters contained in the above description or shown in the accompanying drawings shall be interpreted as illustrative and not in a limiting sense.

In view of the above, it will be seen that the several objects of the invention are achieved and the advantageous results attained.

I claim:

1. An electrical resistor device comprising at least one thermally expandable resistor element of a ceramic material having a positive temperature coefficient of resistivity adapted to be heated to an elevated temperature when electrical current is directed through the element, a thin electrically conductive metallic coating adherent to the ceramic material along at least one surface of the ceramic element providing a low contact resistance surface for making low resistance electrical contact to the ceramic resistor element, an electrically conductive metal plate member in engagement with the coating to make electrical contact with the coating for connecting the resistor element in an electrical circuit, a casing receiving the coated ceramic element and plate member therein, and resilient means biasing the resistor element to a selected position in the casing for positioning the ceramic element in the casing while permitting thermal expansion of the element when electrical current is directed therethrough, said resilient means being movably engaged with said plate for accomplishing said positioning of the resistor element and for retaining the plate in electrical contact with said coating during such thermal expansion of the ceramic element while protecting the integrity of the coating during such thermal expansion.

2. An electrical resistor device comprising a ceramic casing having a chamber, a plurality of disc-shaped thermistor elements within said casing chamber, each of said thermistor elements having an electrically resistive body of a ceramic material having first and second disc surfaces on opposite sides of said body and having an adherent metallized coating on each of said disc surfaces forming an ohmic contact surface on said body, said thermistor elements being disposed in stacked relation in said body in series connected heat transfer relation to each other, an electrically conductive metal disc disposed at each end of said stack of thermistor elements in engagement with an ohmic contact surface of a thermistor element at said end of said stack of thermistor elements, a pair of electrical terminals fixedly mounted in said casing and having a pointed contact portion within the casing and resilient electrically conductive means disposed within said chamber at respective ends of said stack of thermistor elements in engagement with one of said metal discs, said pointed contact portion of said terminal engaging said resilient means applying a selective force to said means for resiliently positioning said thermistor elements in said casing chamber and for electrically connecting said thermistor elements in series, said resilient means cooperating with each of said metal discs for permitting thermal expansion of said thermistor elements in said casing while retaining the integrity of said metallized thermistor surfaces during said thermal expansion.

3. An electrical resistive device as set forth in claim 2 wherein said resilient means each comprises a wave-shaped member of resilient electrically conductive metal.

4. An electrical resistor device comprising a ceramic casing having a chamber, a plurality of PTC elements within said casing chamber, each of said PTC elements having an electrically resistive body of a ceramic material having first and second disc surfaces on opposite sides of said body and having an adherent metallized coating on each of said disc surfaces forming an ohmic contact surface on said body, said PTC elements being disposed in stacked relation in said body in series connected heat transfer relation to each other, an electrically conductive metal disc disposed at each end of said stack of PTC elements in engagement with an ohmic contact surface of a PTC element at said end of said stack of PTC elements, a pair of electrical terminals fixedly mounted in said casing, and having a pointed contact portion with the casing, and resilient electrically conductive means disposed within said chamber at respective ends of said stack of PTC elements in engagement with one of said metal discs, said pointed contact portion of said terminal engaging said resilient means applying a selective force to said means for resiliently positioning said PTC elements in said casing chamber and for electrically connecting said PTC elements in series, said resilient means cooperating with each of said metal discs permitting thermal expansion of said PTC elements in said casing while retaining the integrity of said metallized PTC surfaces during said thermal expansion.

5. An electrical resistive device as set forth in claim 4 wherein said resilient means each comprises a wave-shaped member of resilient electrically conductive metal.

* * * * *